US011168952B2

(12) United States Patent
Palkow

(10) Patent No.: US 11,168,952 B2
(45) Date of Patent: Nov. 9, 2021

(54) MECHANISM FOR SELECTIVELY PREVENTING CYCLING OF A SEMIAUTOMATIC HANDGUN

(71) Applicant: Kenney's Custom Props, LLC, Fleetwood, PA (US)

(72) Inventor: Kenneth Palkow, Fleetwood, PA (US)

(73) Assignee: Kenney's Custom Props, LLC, Fleetwood, PA (US)

( * ) Notice: Subject to any disclaimer, the term of this patent is extended or adjusted under 35 U.S.C. 154(b) by 313 days.

(21) Appl. No.: 16/352,263

(22) Filed: Mar. 13, 2019

(65) Prior Publication Data

US 2019/0285373 A1 Sep. 19, 2019

Related U.S. Application Data

(60) Provisional application No. 62/644,607, filed on Mar. 19, 2018.

(51) Int. Cl.
*F41A 3/48* (2006.01)
*F41A 21/30* (2006.01)
*F41A 19/16* (2006.01)

(52) U.S. Cl.
CPC ..... *F41A 3/48* (2013.01); *F41A 19/16* (2013.01); *F41A 21/30* (2013.01)

(58) Field of Classification Search
CPC ..... F41A 3/36; F41A 3/42; F41A 3/48; F41A 3/52; F41A 3/68; F41A 3/70
USPC ..... 89/180, 181, 187.01, 188, 189, 190
See application file for complete search history.

(56) References Cited

U.S. PATENT DOCUMENTS 4,176,584 A * 12/1979 Thomas, Jr. ..... F41A 17/38 89/138
4,512,236 A 4/1985 Thevis et al.
7,228,780 B1 * 6/2007 Thomele ..... F41A 17/42 42/70.01
2014/0338243 A1 * 11/2014 La Vigne ..... F41A 35/06 42/16
2019/0086169 A1 3/2019 Hopkins et al.
2019/0162493 A1 * 5/2019 Hopkins ..... F41A 3/42

OTHER PUBLICATIONS

Paulson, Suppressed: Quick-mount unit boasts usable night sights, Guns & Weapons for Law Enforcement, Feb. 2000, 7 pages.

* cited by examiner

*Primary Examiner* — Bret Hayes
(74) *Attorney, Agent, or Firm* — Wood Herron & Evans LLP

(57) ABSTRACT

Provided is a mechanism for selectively preventing cycling of a semiautomatic handgun having a frame and a longitudinally reciprocating slide. The device includes a pivotal blocking lever on one of the slice or frame. The blocking lever is selectively movable between a first position that allows the slide to cycle when the handgun is fired and a second position in which a blocking member mechanically bridges between the frame and slide to block cycling movement of the slide when the handgun is fired.

5 Claims, 18 Drawing Sheets

MECHANISM FOR SELECTIVELY PREVENTING CYCLING OF A SEMIAUTOMATIC HANDGUN

RELATED APPLICATIONS

This application claims priority to U.S. Provisional Patent Application No. 62/644,607, filed Mar. 19, 2018, and incorporates the same herein by reference.

TECHNICAL FIELD

This Invention relates to a mechanism that may be adapted to a semiautomatic handgun that allows the user to selectively prevent cycling of the slide when fired, causing it to operate as a single-shot firearm.

BACKGROUND

The function and operation of semiautomatic handguns are well known to those skilled in the art. When the trigger is pulled, a striker or firing pin is caused to impact the primer of an ammunition cartridge, firing a bullet from the barrel. Part of the propellant pressure that launches the projectile also causes the slide to cycle rearwardly, extracting and ejecting the spent casing. As the slide returns forward by spring force, a fresh cartridge is fed from a magazine and pushed into the chamber of the barrel automatically. Pulling the trigger again causes the cycle to repeat.

A significant amount of the propellant blast exits the muzzle of the barrel behind the projectile and the rapid release of the expanding gases creates a loud report. This sound can be reduced considerably by effective noise suppressor devices, or silencers, which has become increasingly popular. Typically, a suppressor is a device attached to the muzzle of the barrel providing a housing with its interior space divided into multiple chambers by baffles. Such a noise suppressor delays and prolongs the release of the expanding propellant gases which create a shockwave in the air to produces soundwaves.

Other sources of sound, however, also contribute to the report. When a projectile is fired at a speed greater than the speed of sound traveling through air, it creates a small "sonic boom" that is perceived as a loud "crack." Using "subsonic" ammunition, which propels the projectile at a speed slower than that of sound through air, will eliminate this portion of the report. Some pistol calibers of ammunition, such as .45ACP, are almost always subsonic. Other calibers of pistol ammunition that are typically supersonic may be available in subsonic loads.

A third source of sound is produced by various parts of the slide mechanism contacting other parts as it cycles to the rear and returns forward into battery. The sound of this mechanical action may be considered by some to be relatively insignificant when firing an unsuppressed handgun in a center-fire caliber. Using an effective suppressor with subsonic center-fire or rimfire (such as .22LR) caliber ammunition can almost completely eliminate the sound of the muzzle blast, reducing it to the sound level of an air gun. In this example, the sound produced by the cycling mechanism becomes significant and may be greater than that of the propellant blast.

If one prevents the slide of a semiautomatic handgun from cycling when fired, effectively turning it into a single-shot firearm, the sound produced by the cycling mechanism can be completely eliminated. It can be dangerous, however, to attempt blocking movement of the slide with one's hand, for example. In the past, a device has been used that hinged to a forward part of the dust cover or frame, under the barrel, and could be lifted to engage a notch formed in the slide to prevent cycling. This device, however, would cover any accessory rail, making the rail unusable. It also was a bulky, external mechanism that was prone to inadvertent actuation.

SUMMARY OF THE INVENTION

The present invention provides a mechanism for selectively preventing cycling of a semiautomatic handgun, thereby effectively making it a single-shot firearm and eliminating the sound produced by cycling of the slide. It may include a blocking lever or member that is movable to a blocked position in which it mechanically interlocks the frame and slide to prevent cycling. The blocking lever may be independent of any external manual safety lever on the handgun.

It may, for example, be located opposite to a thumb safety lever on the frame, or it may be located on the slide, in either case moving a blocking member into blocking interference between the frame and slide.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

Figure 21:
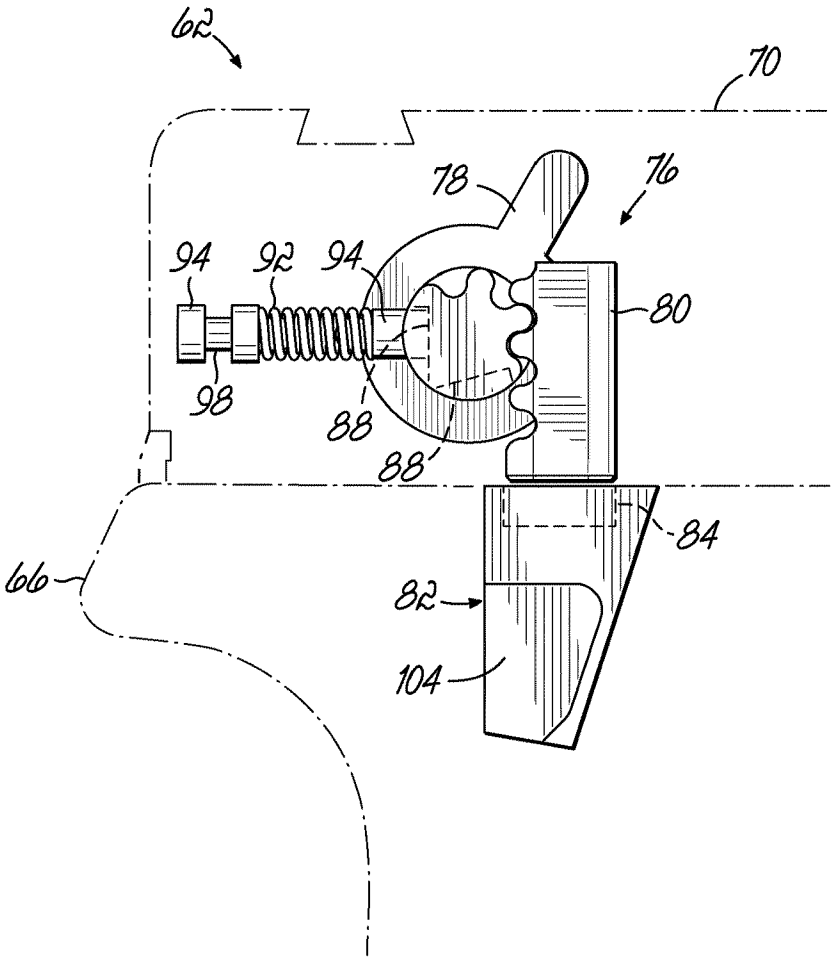
Figure 20:
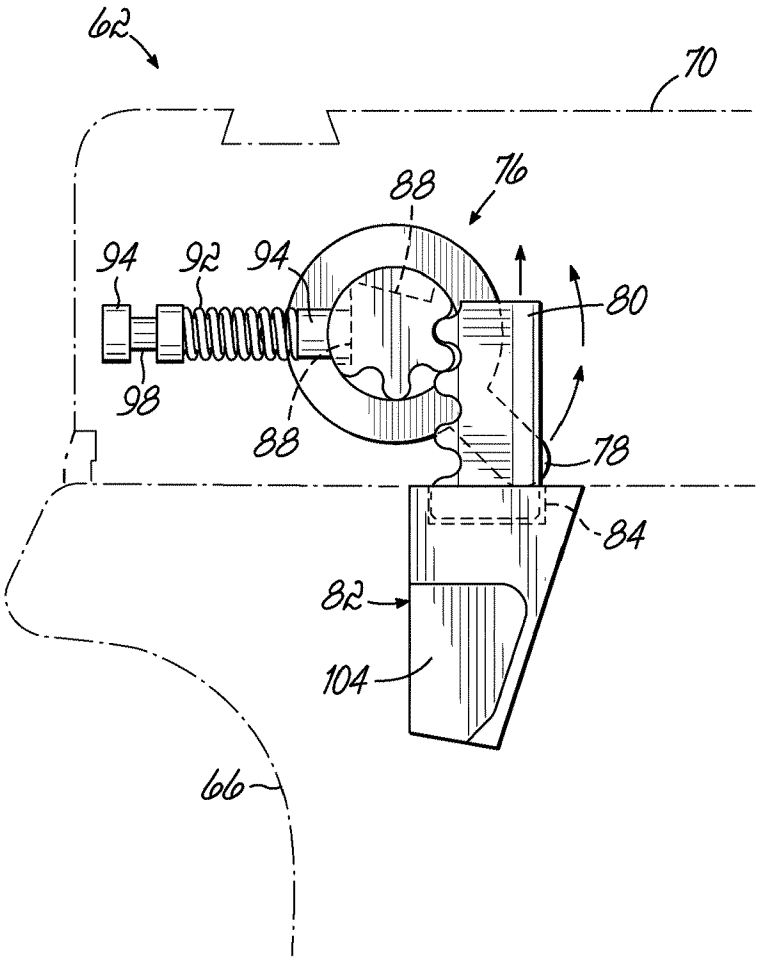
Figure 22:
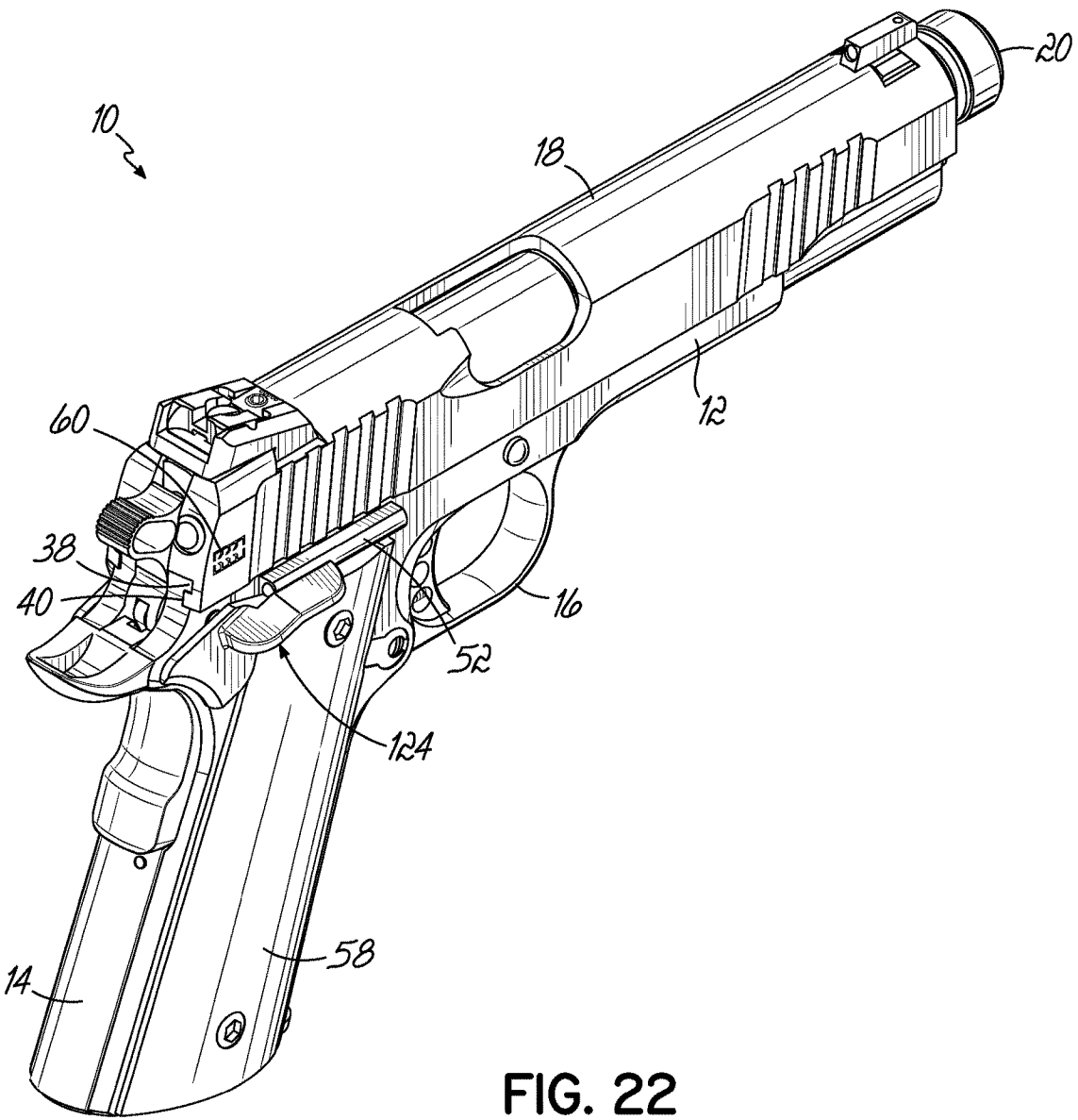
Figure 23:
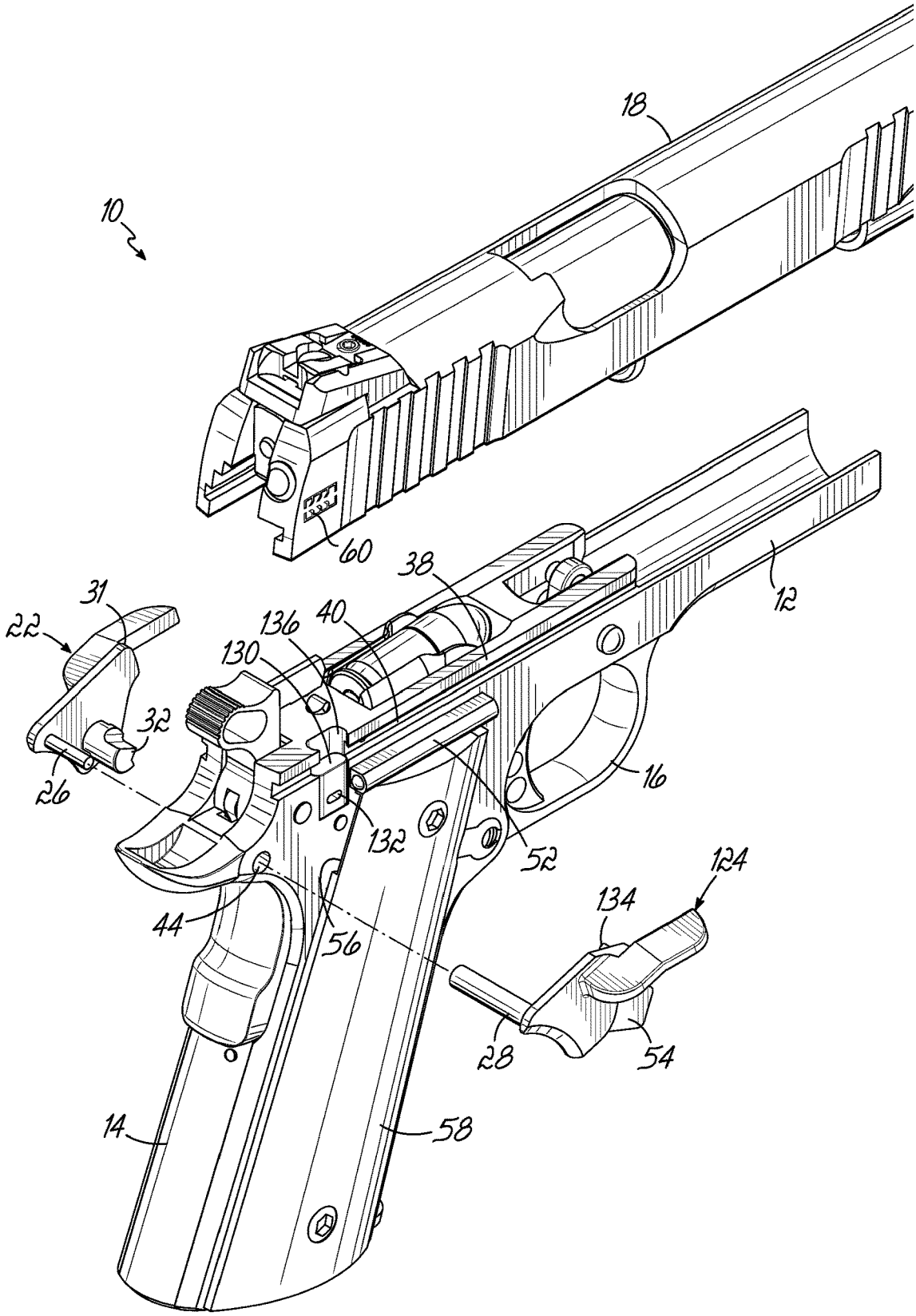
Figure 25:
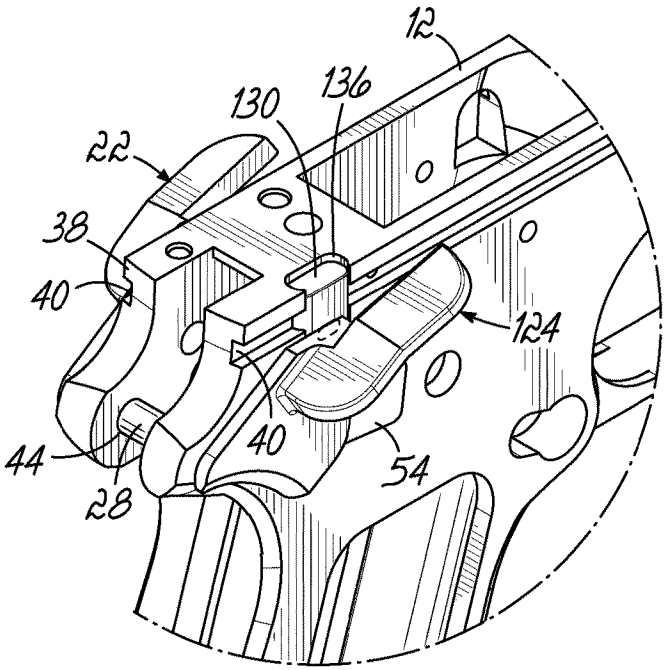
Figure 24:
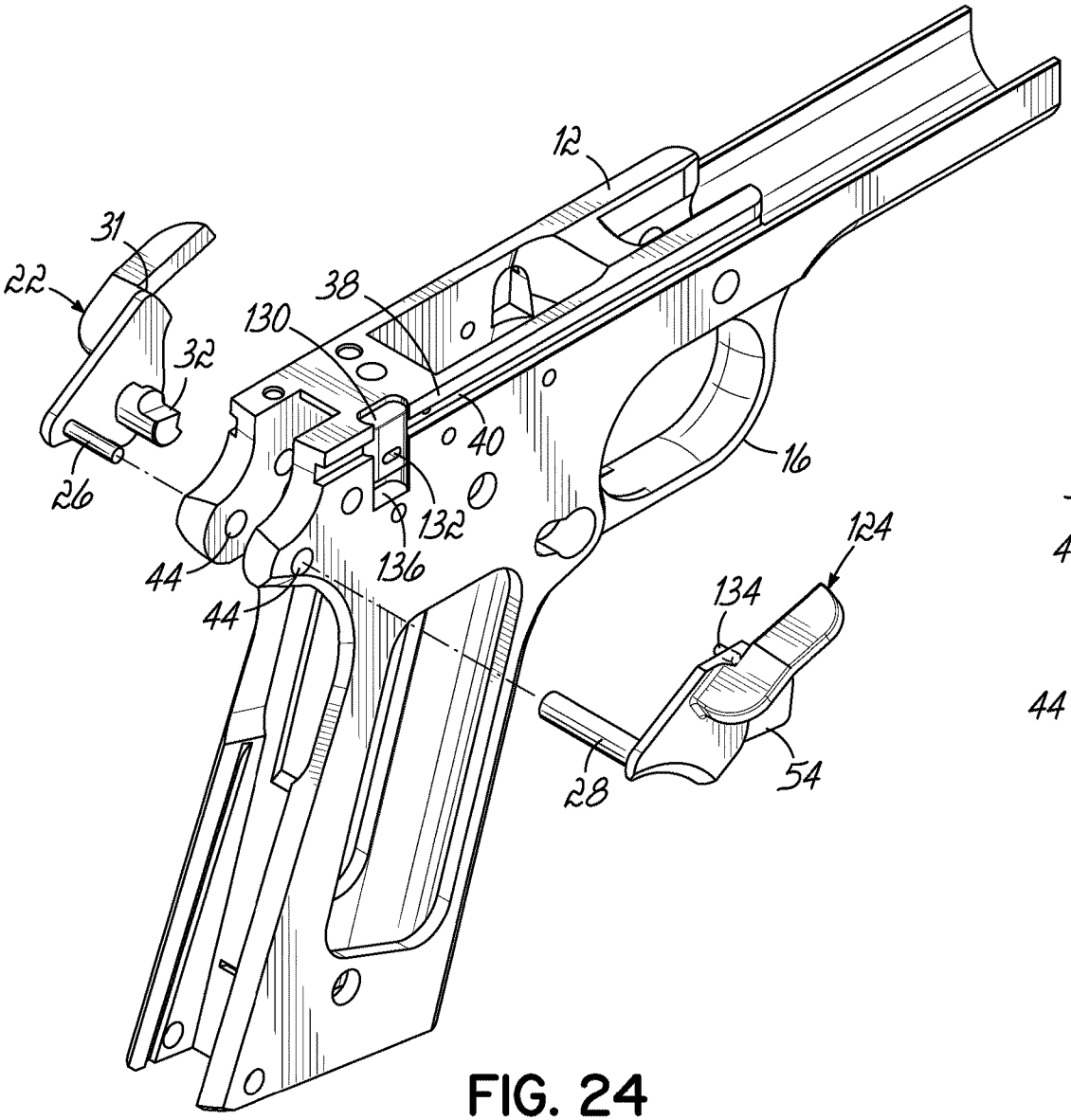
Figure 26:
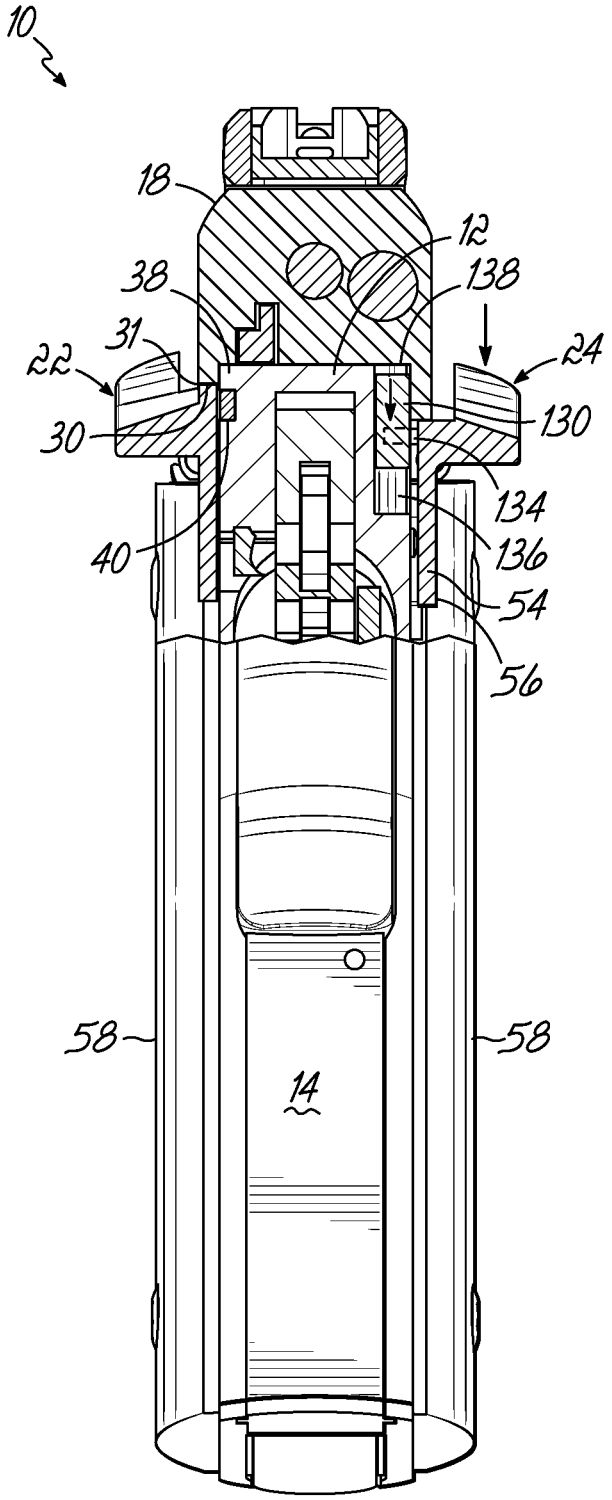
Figure 27A:
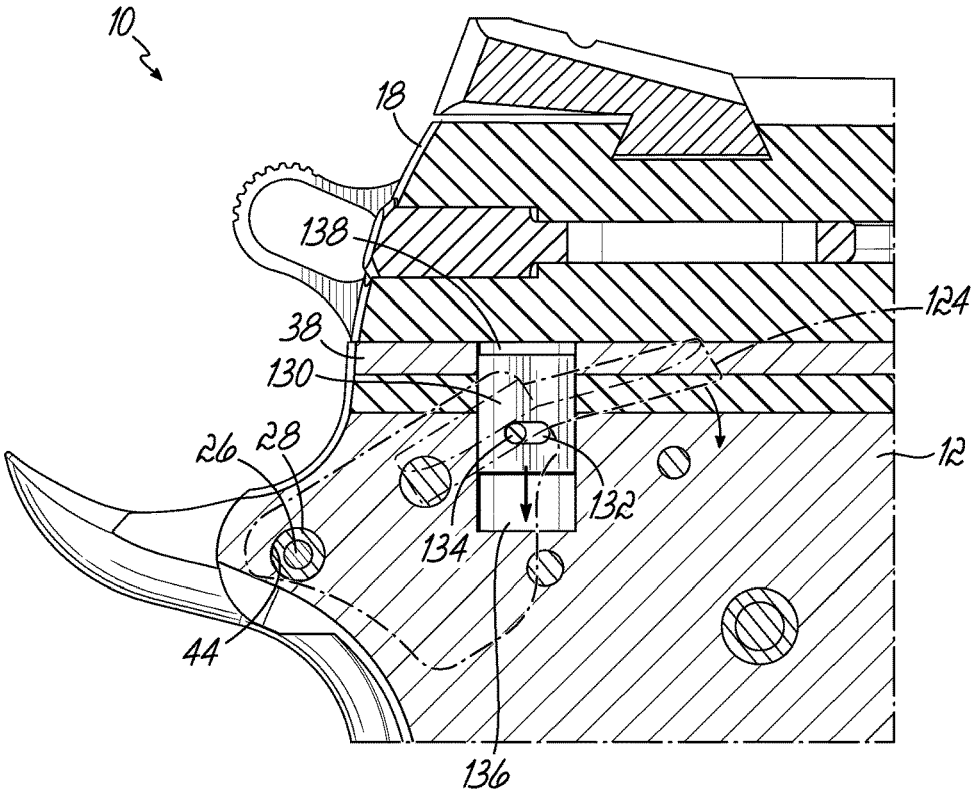
Figure 27B:
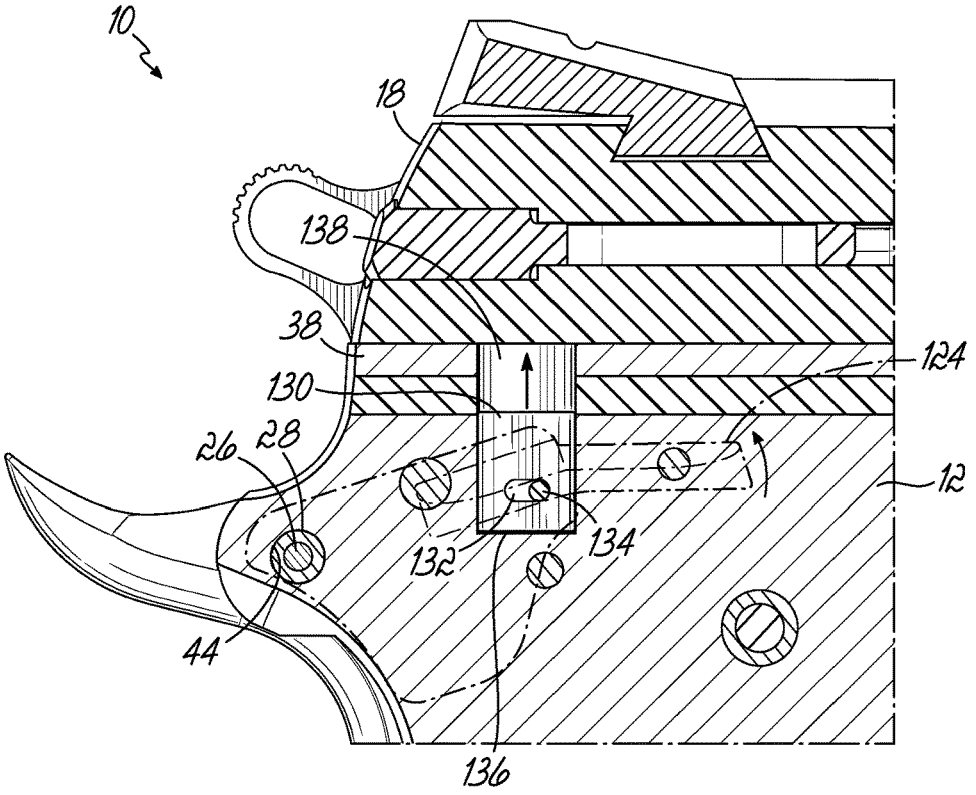

is an enlarged fragmentary side view of a slide with the blocking mechanism engaged with a frame insert member;

FIG. 20 is a side view of the blocking mechanism engaged with the frame insert;

FIG. 21 is a similar view in a disengaged position;

FIG. 22 is an isometric view of a third embodiment of the invention;

FIG. 23 is an exploded isometric view thereof;

FIG. 24 is an exploded isometric view showing only the frame, thumb safety lever, and blocking mechanism of the third embodiment;

FIG. 25 is an enlarged detail view thereof in an assembled condition;

FIG. 26 is a rear, partially cut-away view thereof with the blocking mechanism in an engaged position;

FIG. 27A is a longitudinal sectional detail view with the lever shown in phantom showing the mechanism in a n engaged position; and FIG. 27B is a similar view showing the mechanism in a disengaged position.

DETAILED DESCRIPTION

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 1:
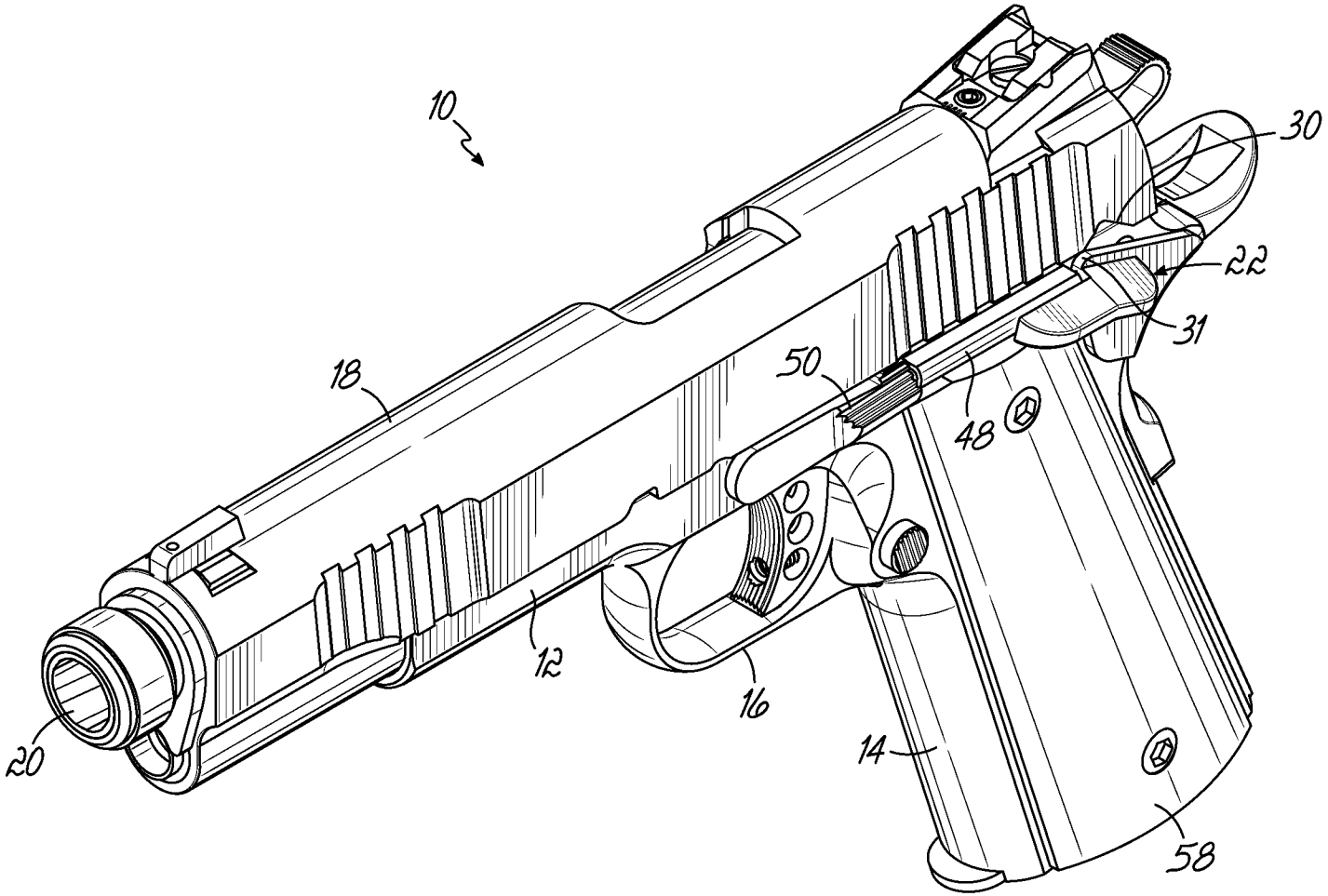
FIG. 1 is isometric view of a semiautomatic handgun including a selective slide-blocking mechanism according to an embodiment of the present invention.
Figure 2:
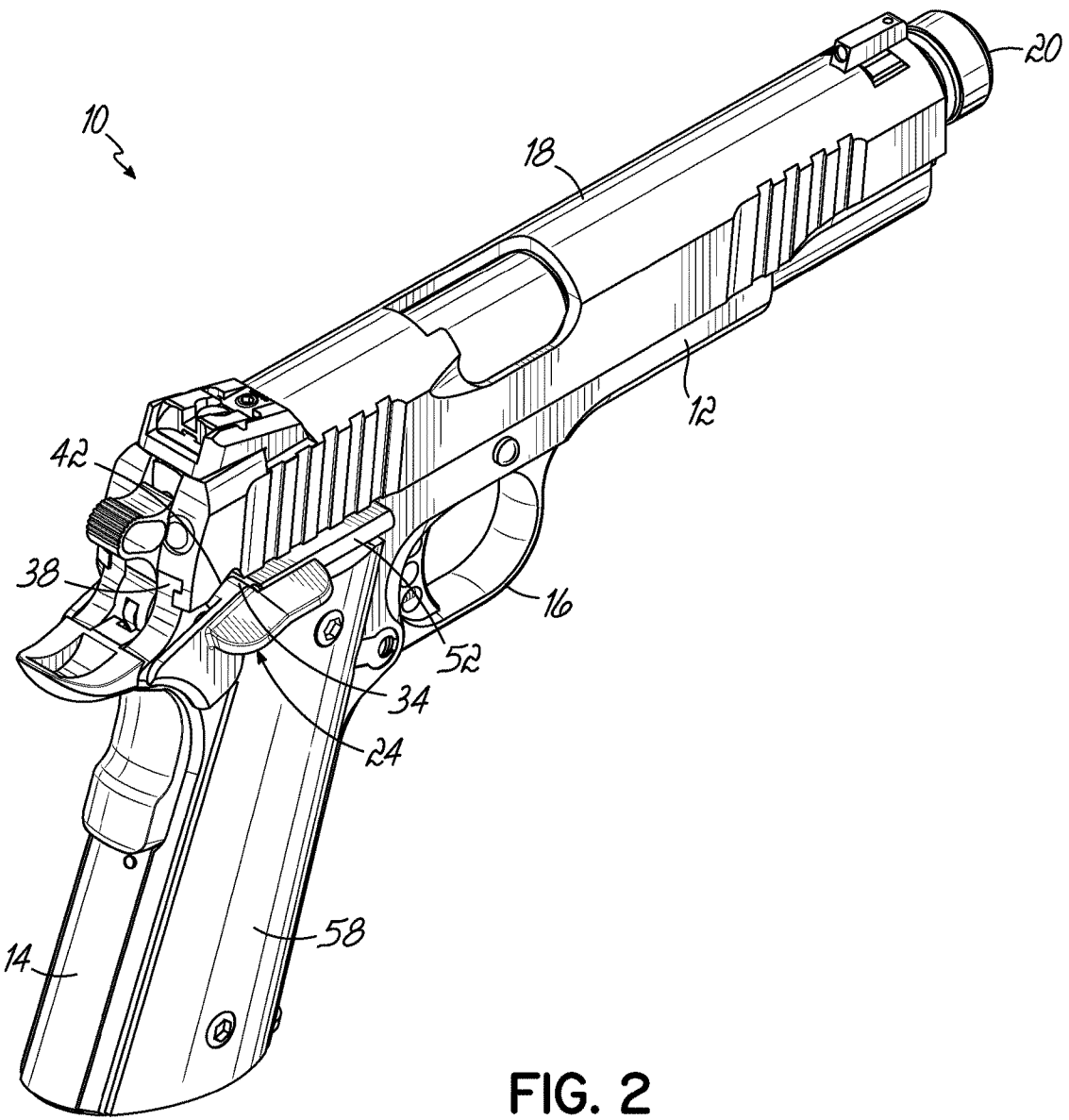
FIG. 2 is an opposite isometric view thereof.

Referring first to FIGS. 1 and 2, therein is shown a semiautomatic handgun 10 with a mechanism according to an embodiment of the present invention installed thereon for selectively preventing cycling of the slide. The handgun 10 includes a frame 12 with a grip portion 14 and trigger guard 16. As is typical of semiautomatic handguns, an ammunition magazine may be inserted into the grip portion 14 of the frame 12. A slide 18 is mounted on the frame 12 to reciprocate rearwardly and forwardly thereon relative to the frame 12 and barrel 20. The handgun 10 illustrated in FIGS. 1-13 is a 1911-pattern (M1911A1) handgun that is hammer-fired. Other embodiments of the present invention may be adapted to other handgun models, including striker-fired handguns.

The illustrated handgun 10 includes a manual safety lever 22 in the common position on the left side of the frame 12 (FIG. 2). On the opposite side, there is a slide blocking lever 24 (shown in FIG. 1). Referring now also to FIGS. 3-6, in this embodiment, the manual safety lever 22 and slide blocking lever 24 may be mounted on a frame 12 for independent pivotal movement about coaxially aligned axle portions 26, 28. Unlike an ambidextrous safety lever in which opposite side levers move in unison, the slide blocking lever 24 of the present invention operates independently of any manual safety device.

As shown in FIG. 1, the slide 18 may include a safety engagement notch 30 configured to receive an upper portion 31 of the manual safety lever 22 when rotated upwardly to the "safe" position. In this position, in a 1911-pattern handgun, a blocking portion 32 of the manual safety lever 22 mechanically interferes with displacement of the sear and hammer (not shown) in a well-known manner. The upper portion 31 of the manual safety lever 22 engages the safety notch 30 to prevent the slide 18 from being displaced from its in-battery position. Because the handgun 10 cannot be fired when the manual safety lever 22 is in the "safe" position, it is not intended to block the slide 18 from movement resulting from the blow-back recoil force of firing the handgun 10. Any forces of the slide 18 against the manual safety lever 22 are transferred to the frame 12 solely through the axle portion 26.

In contrast, the slide blocking lever 24 is not a "safety" switch and the handgun 10 may be fired while it is in either position. In this embodiment, the slide blocking lever 24 includes an abutment portion 34 that slidably fits into an arcuate pocket 36 formed in the frame 12. The depth and position of the pocket 36 can be such that it extends into a portion of the guide rail 38 and spans the guide channel 40 on which the slide 18 reciprocates. The slide 18 may include a locking notch 42 positioned to correspond to the pocket 36 when the slide 18 is in its forward, in-battery position. The abutment portion 34 is sized such that it extends into the pocket 36 in a first position where the abutment portion 34 is clear of the locking notch 42 of the slide 18 and clear of the channel 40 and guide rail 38 of the frame 12. The slide blocking lever 22 can be pivoted about its axle portion 28 to move the abutment portion 34 into engagement with the locking notch 42 and an upper portion of the pocket 36 that extends through the guide channel 40 and may extend into the guide rail 38 of the frame 12. As viewed in FIG. 7, the engagement of the abutment portion 34 of the slide locking lever 24 may be compared to that of the manual safety lever 22, both being shown in the engaged position.

Unlike in the case of an ambidextrous manual safety lever (not shown) in which opposite side levers are mechanically interconnected to move in unison, the axle portions 26, 28 of the manual safety lever 22 and slide blocking lever 24 can fit together coaxially, allowing them to move independently of each other. A tubular axle (illustrated at 28 on the slide blocking lever 24) may have an outer diameter sized to be received by aligned openings 44 at the rear of the frame 12 and a tubular bore 26*a* that receives the axle 26 of the safety lever 22. The tubular axle 28 may extend from either of the levers 22, 24. A rod-like member (shown at 26 on manual safety lever 22) may extend from the opposite lever and be received within an opening 26*a* defining an axial bore of the tubular axle portion 28.

As is well-known in the art, a spring detent assembly 48 may be provided on the frame 12 to releasably hold the manual safety lever 22 in either the "safe" or "fire" position. In a 1911-pattern handgun, this spring detent assembly 48 may also engage a slide lock-back lever 50. A similar spring detent assembly 52 may be provided on the opposite side of the frame 12 to releasably hold the slide blocking lever 24 in either a locked (engaged) or unlocked (disengaged) position. The slide blocking lever 24 may also include a forward flange portion 54 that is received within an inlet pocket 56 of the removeable grip 58 to prevent axial displacement of the slide blocking lever 24. Alternatively, detent(s) for the slide blocking lever 24 may be mounted in the frame 12 or grip 58 to engage notch(s) on the flange 54 or elsewhere on the slide blocking lever 24.

Figure 11:
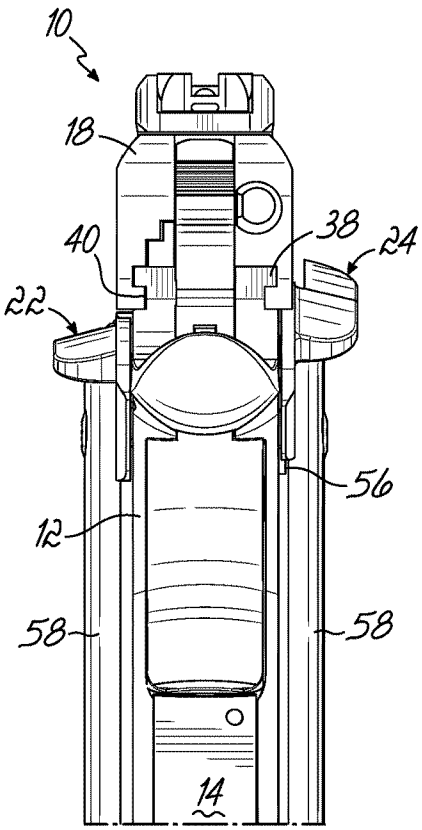
FIG. 11 is a similar view showing the thumb safety engaged (safe) and slide blocking lever disengaged.
Figure 10:
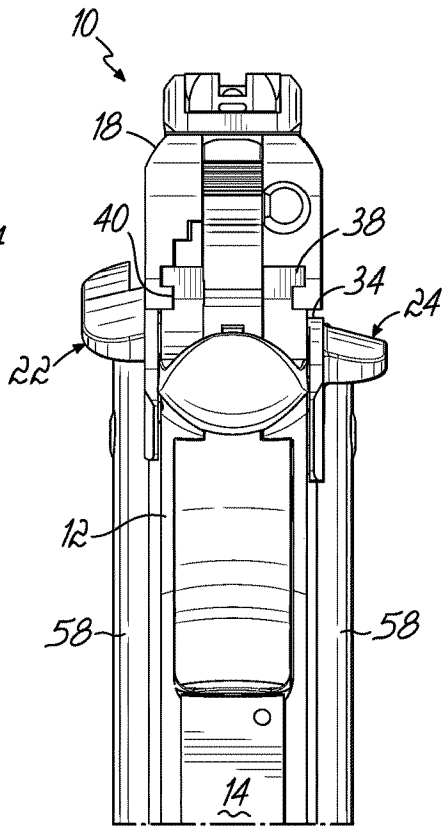
FIG. 10 is a similar view with the thumb safety disengaged (fire) and the slide blocking lever engaged.
Figure 9:
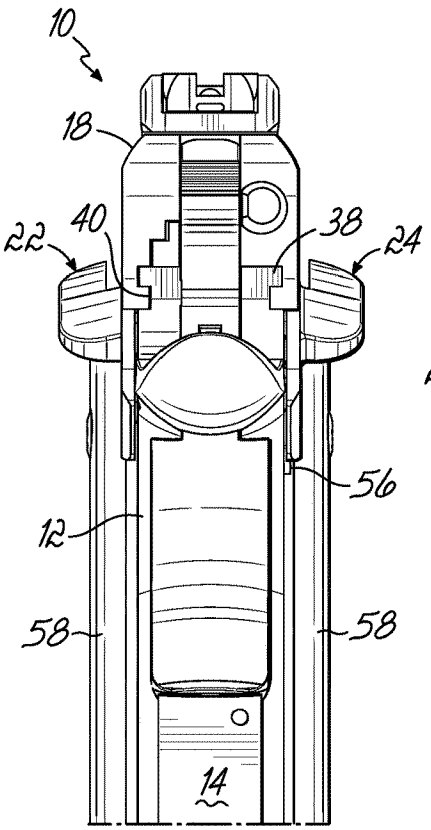
FIG. 9 is a similar view with the thumb safety disengaged (fire) and the slide blocking lever disengaged.
Figure 8:
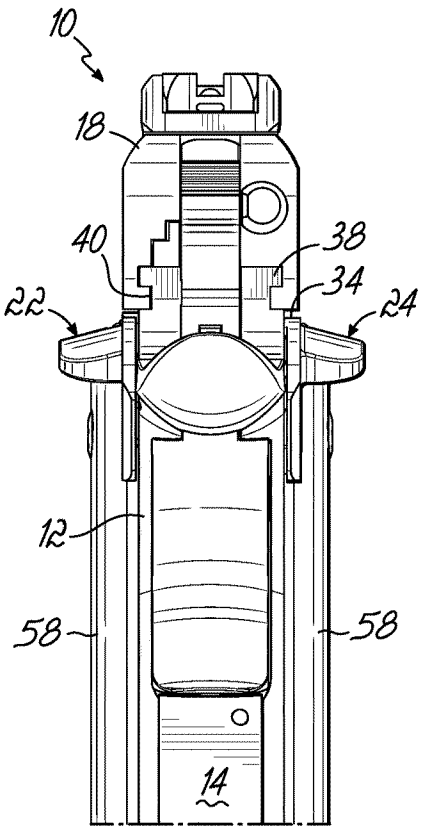
FIG. 8 is a rear view of a semiautomatic handgun with the thumb safety engaged (safe) and slide blocking lever engaged.
Figure 13:
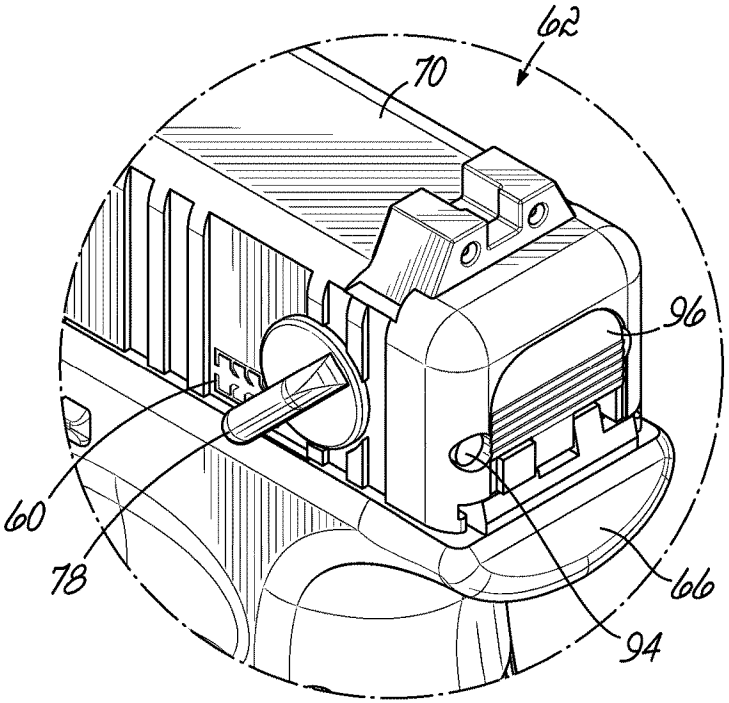
FIG. 13 is an enlarged detail view thereof with the mechanism in the engaged position.
Figure 12:
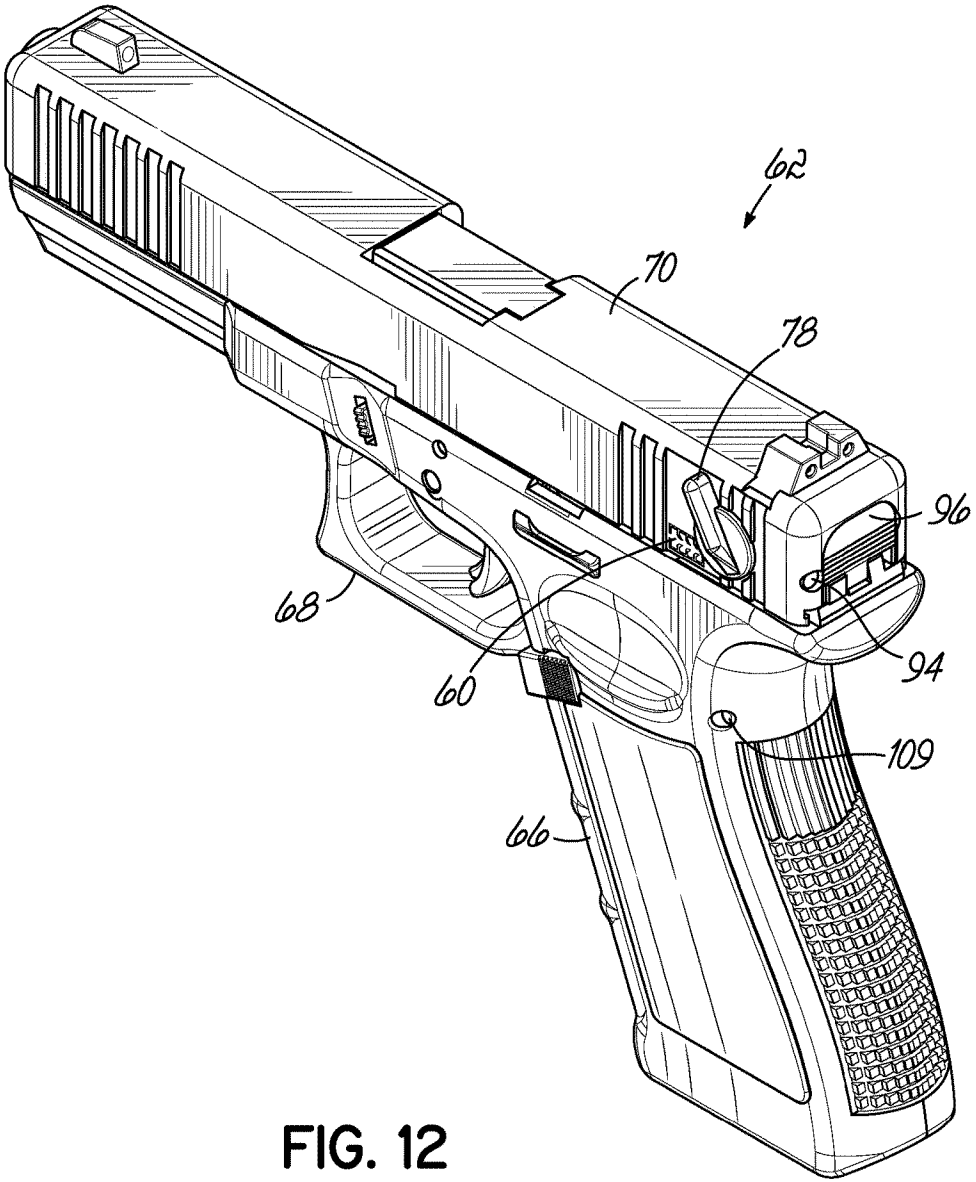
FIG. 12 is an isometric view of a different model handgun with an alternate embodiment slide blocking mechanism of the present invention installed in a disengaged position.
Figure 14:
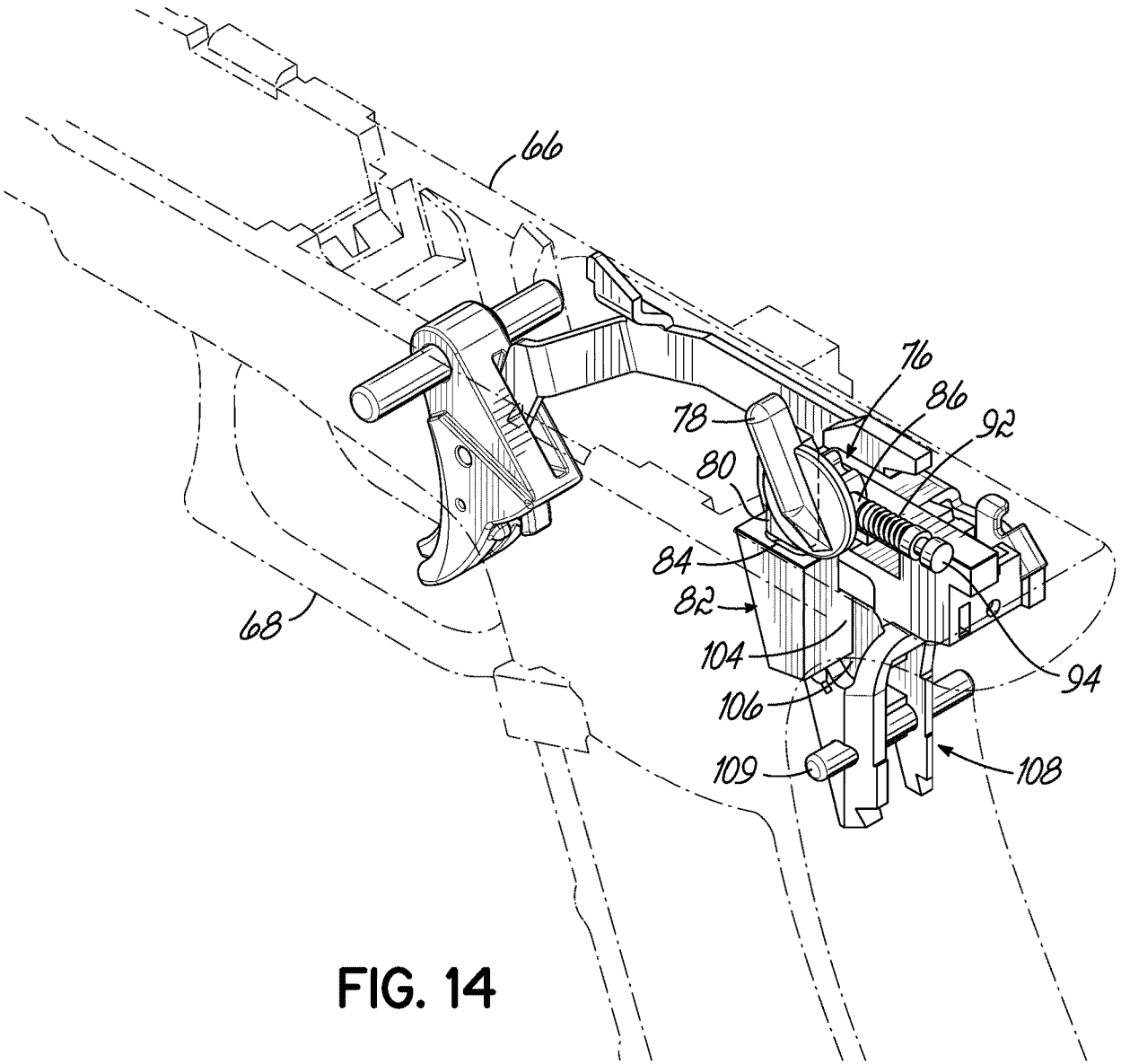
FIG. 14 is a similar view with the slide removed and frame shown in phantom to expose detail.
Figure 16:
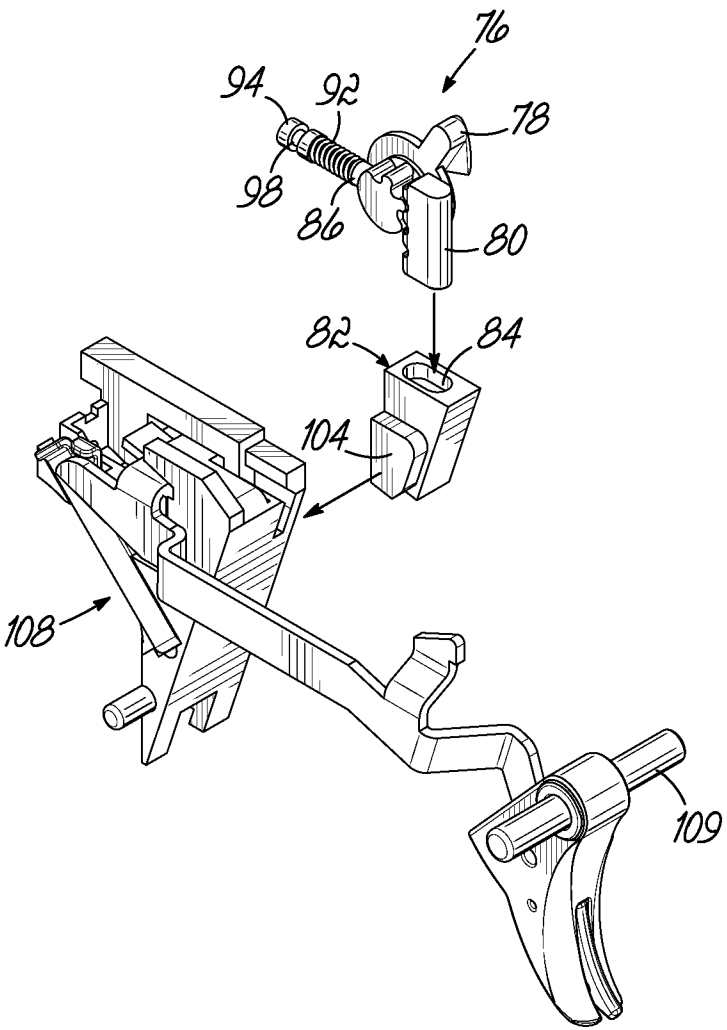
FIG. 16 is an exploded opposite isometric view thereof.
Figure 15:
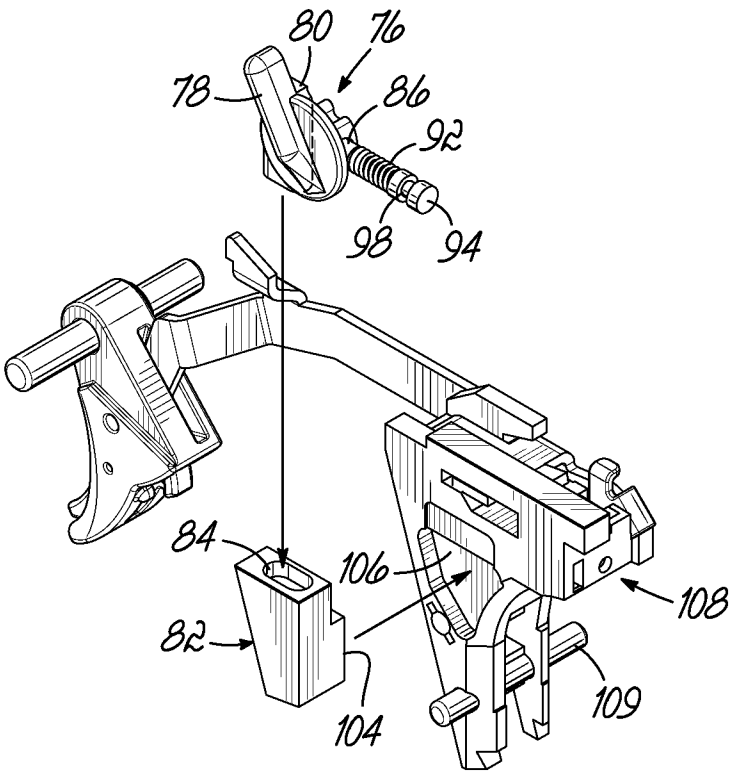
FIG. 15 is an exploded isometric view of trigger components and slide blocking mechanism components of this embodiment.
Figure 17:
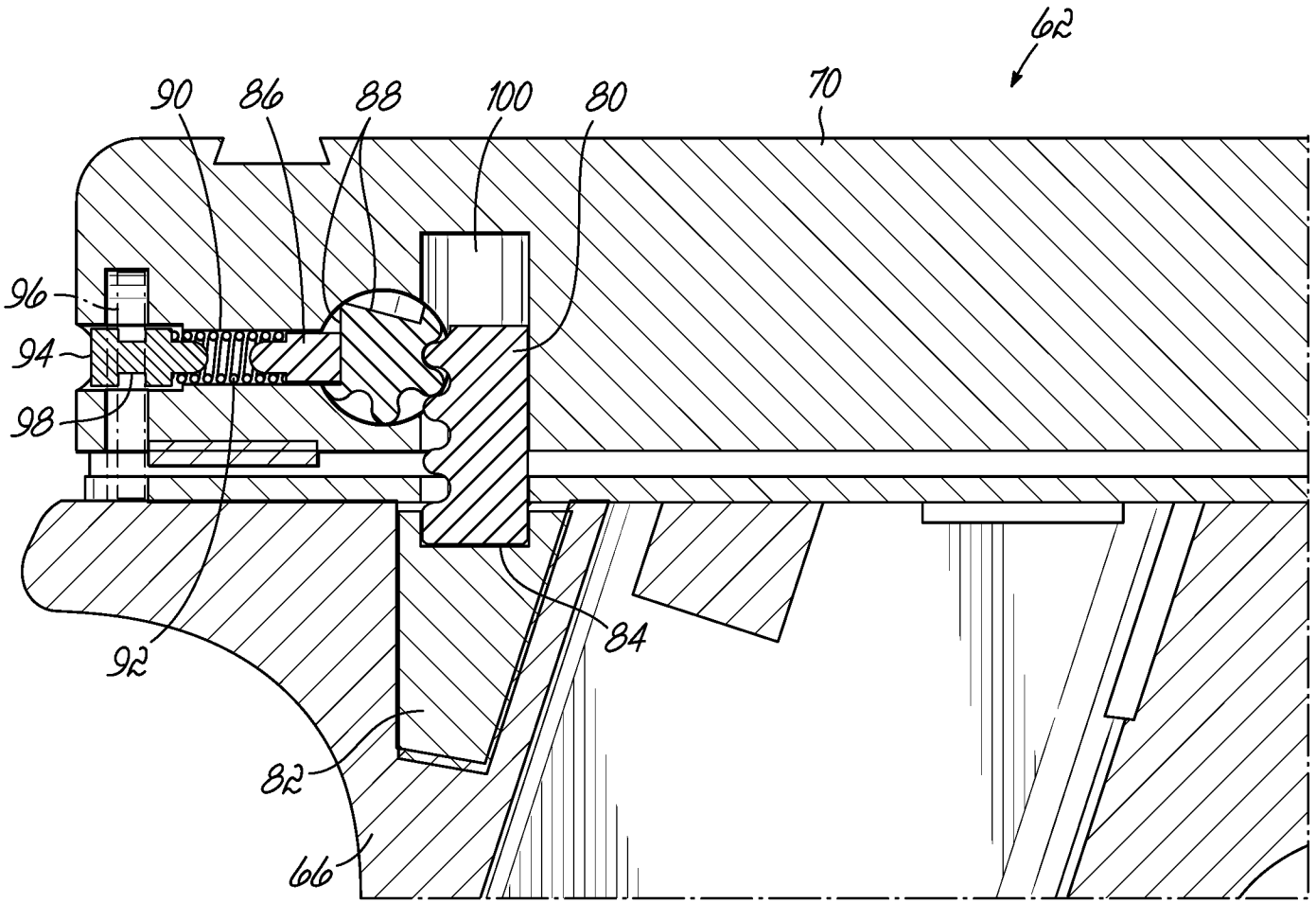
FIG. 17 is a fragmentary side sectional view showing the slide and frame with the blocking mechanism in an engaged position.
Figure 19:
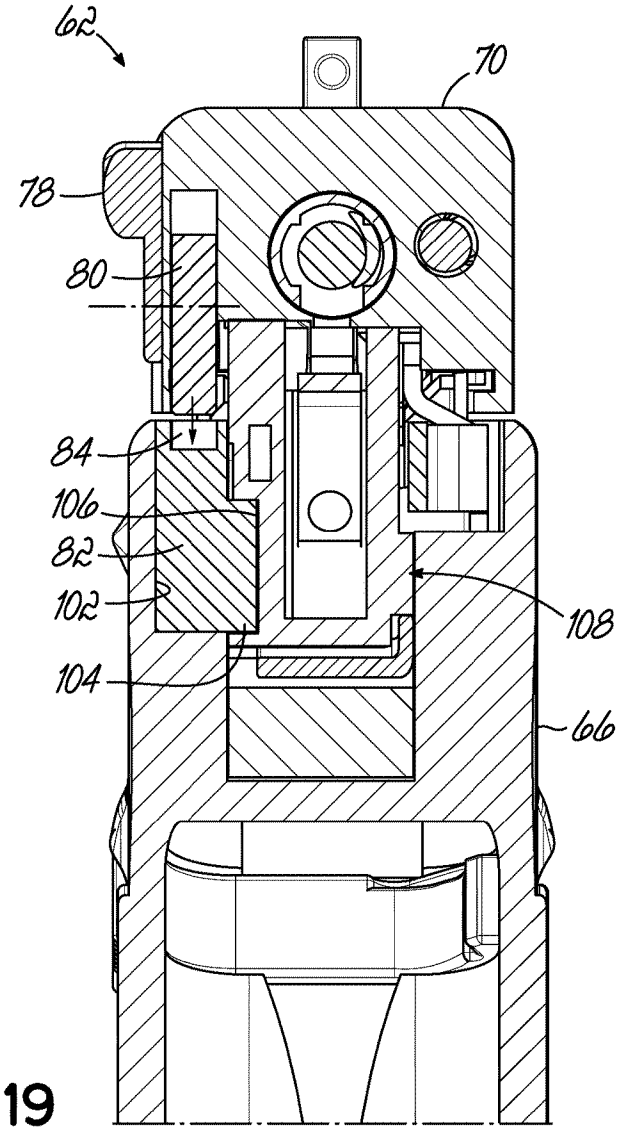
FIG. 19 is a cross-sectional view showing the blocking mechanism disengaged and location of the frame insert.
Figure 18:
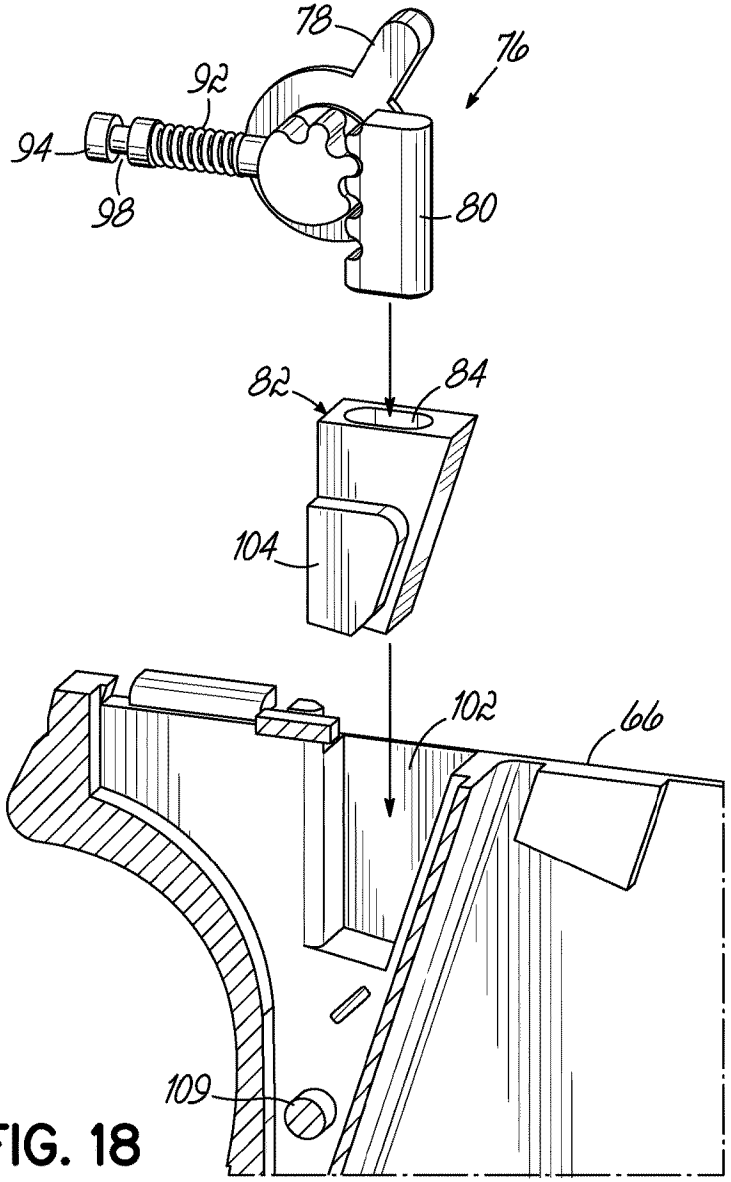
FIG. 18 is an isometric exploded view of the blocking mechanism, frame insert, and sectioned portion of the frame.

FIGS. 8-11 show rear views of a semiautomatic handgun 10, illustrating independent movement of the manual safety lever 22 and slide blocking lever 24. In FIG. 8, the manual safety lever 22 is in a "fire" position and the slide blocking lever 24 is in an unlocked position. In FIG. 9, the manual safety lever 22 is in a "safe" position and the slide blocking lever 24 is in a locked position. In FIG. 10, the manual safety lever 22 is in "safe" position and the slide blocking lever 24 is in the unlocked position. In FIG. 11, the manual safety lever 22 is in the "fire" position and the slide blocking lever 24 is in the locked position.

Figure 3:
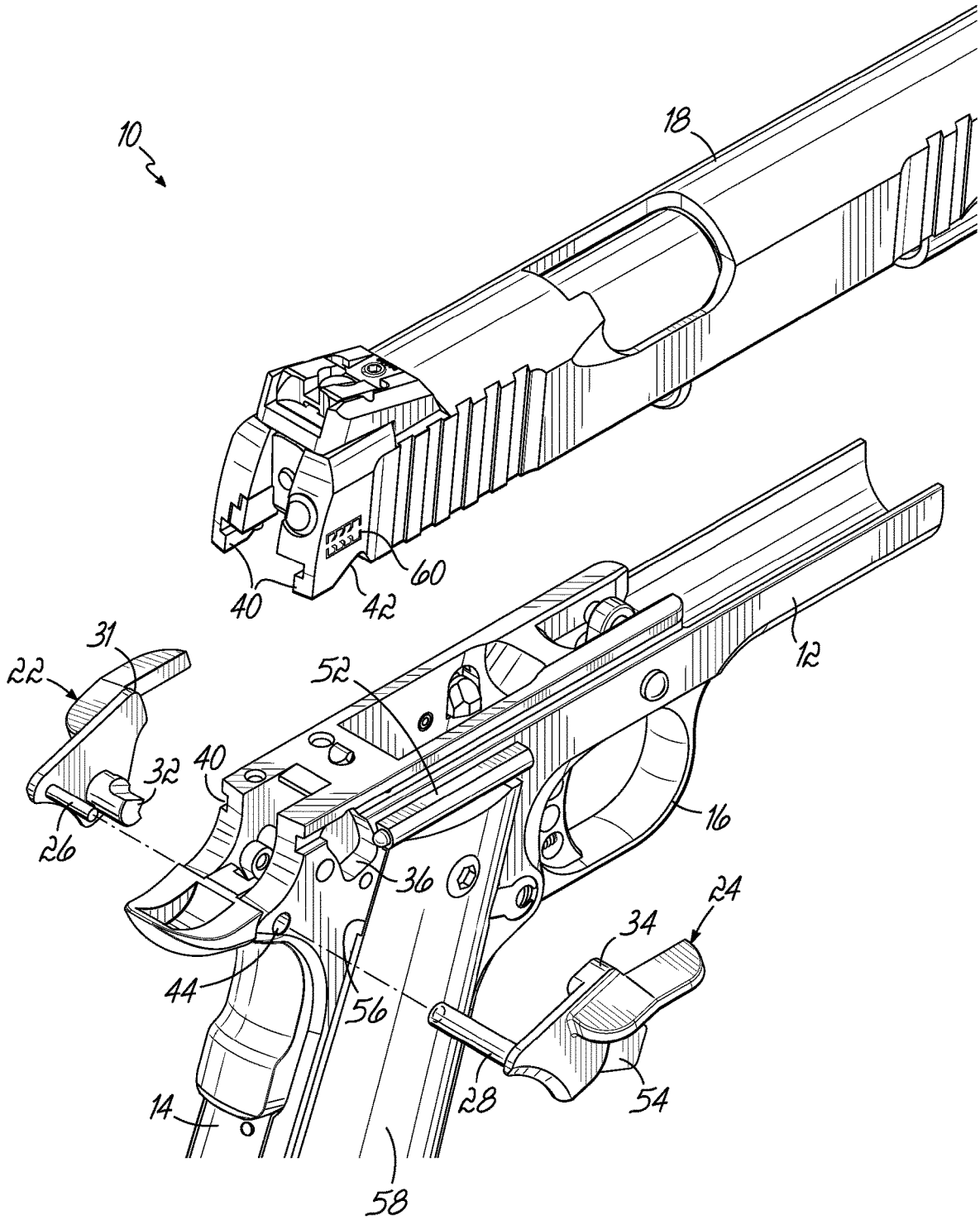
FIG. 3 is an exploded isometric view of a thumb safety and slide blocking lever according to one embodiment of the invention.
Figure 4:
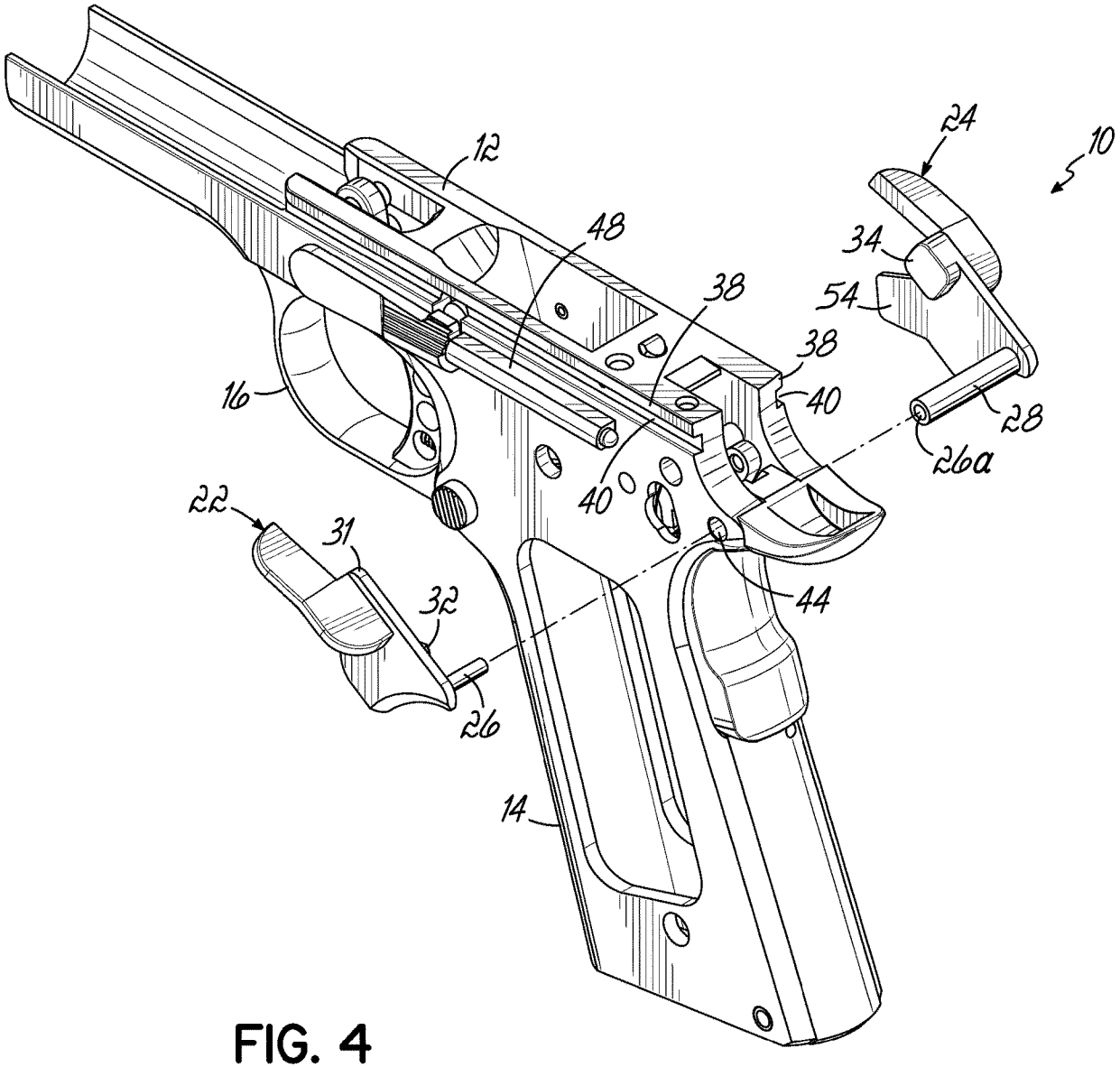
FIG. 4 is an opposite exploded isometric view thereof.
Figure 6:
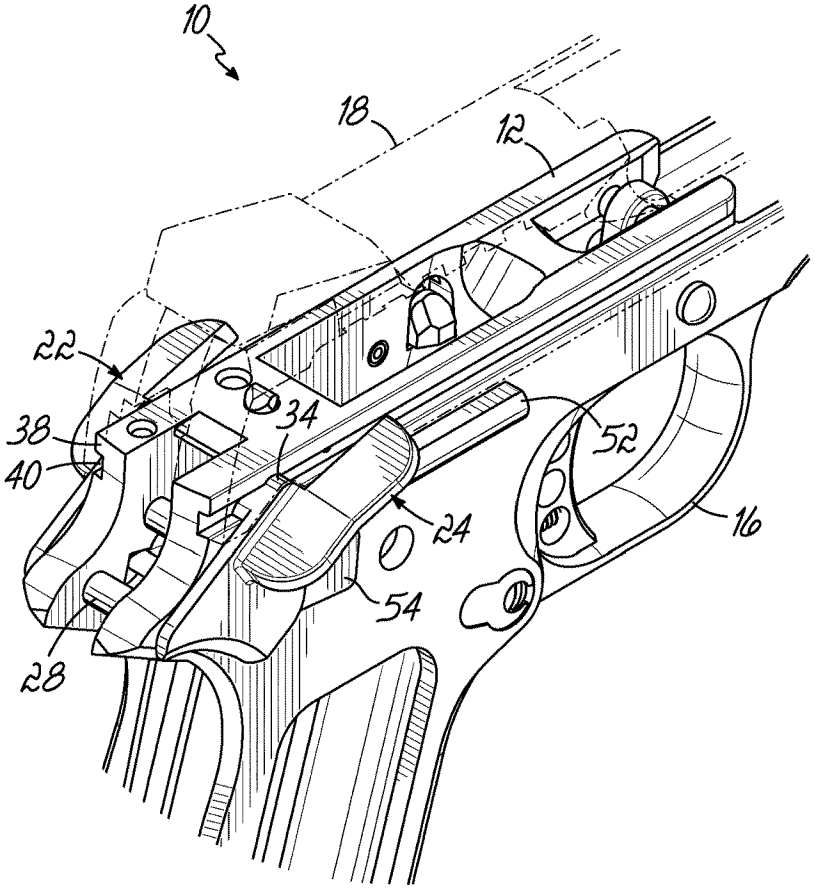
FIG. 6 is an opposite fragmentary isometric view thereof with the slide shown in phantom line.
Figure 5:
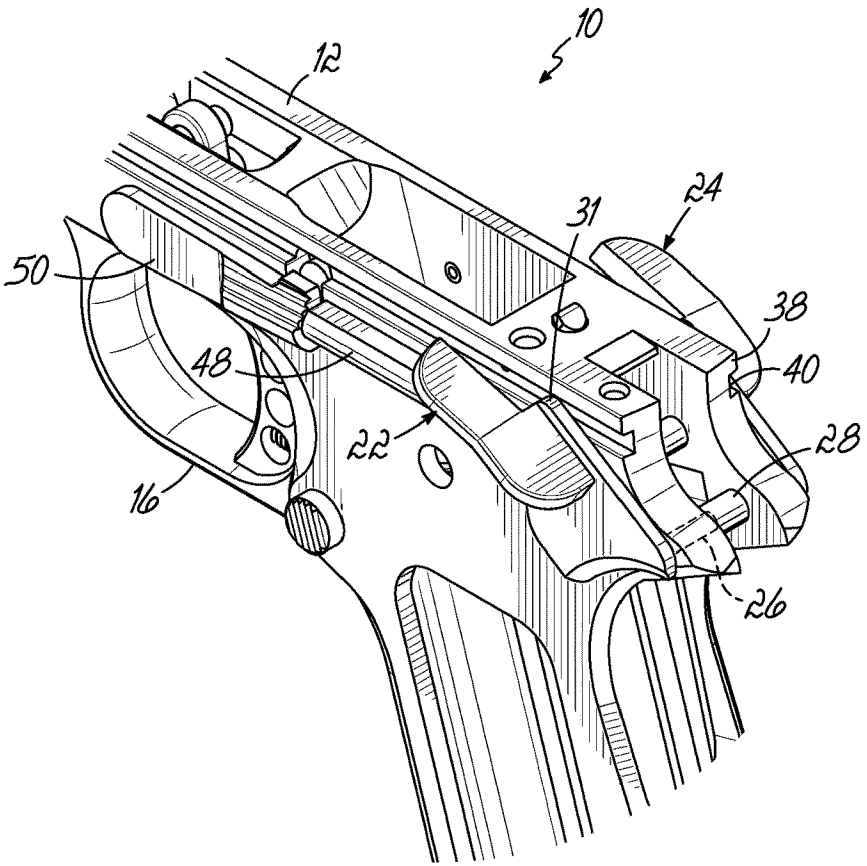
FIG. 5 is a fragmentary isometric view of a handgun frame with the thumb safety and slide blocking lever installed thereon.
Figure 7:
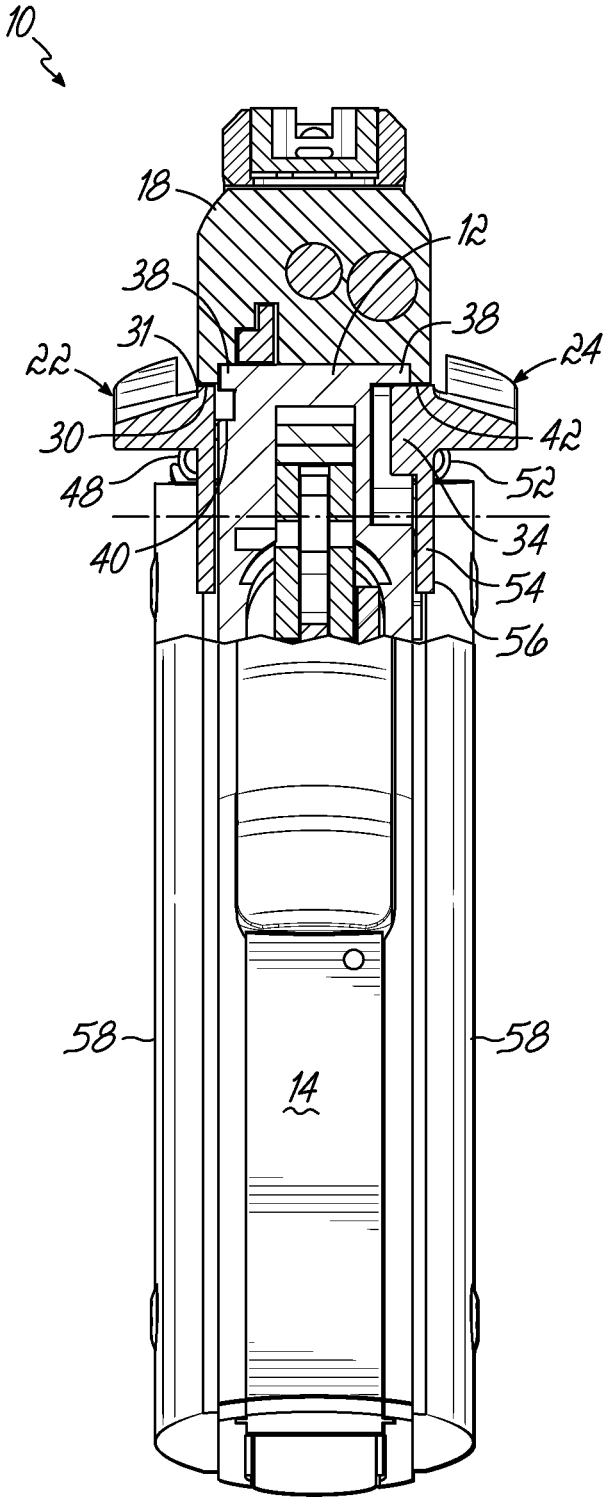
FIG. 7 is a rear partially cut-away view showing both a thumb safety and slide locking lever engaging the slide

As shown in FIG. 3, indicia 60 in the form of a word or symbol may be applied on or near the slide blocking lever 24 to indicate its function. In the illustrated embodiment, indicia 60 representing a firearm noise suppressor is applied to the slide 18 adjacent the position of the slide blocking lever 24.

Although the embodiments heretofore illustrated have been shown in the context of the well-known 1911-pattern handgun, the invention may be modified or adapted for use on other styles of semiautomatic handguns.

Referring now to FIGS. 12-21, therein is shown a slide-mounted blocking mechanism 76, illustrated on a Glock-pattern handgun 62. This embodiment of the mechanism 76 includes a rack-and-pinion arrangement of a rotating lever member 78 and vertically movable blocking bar 80 mounted in/on the slide 70. A reinforcing frame insert 82 may be used to provide a socket 84 that receives the blocking bar 80 when in the engaged position.

The slide-mounted mechanism 76 may be positioned on the slide 70 at a location similar to that of the selector switch on a Glock 18, used to select either semiautomatic or fully automatic fire. For the present invention, the rotating lever member 78 includes coarse gear teeth that engage teeth on the blocking bar 80. The lever member 78 is rotatable between first and second positions in which the blocking bar 80 is either engaged or disengaged from the socket 84 of the frame insert 82. Discrete rotational positions may be provided by a detent member 86 contacting recesses 88 formed on the rotating lever member 78 at preselected positions, such as to provide, for example, about 100° of rotation. The detent member 86 may be guided in a detent channel 90 that receives a detent spring 92. The detent spring 92 can be held in place by a spring retainer 94 that is, in turn, held in place by engagement of the slide cover plate 96 within an annular grove 98. The spring-biased detent member 86 also retains the rotating lever member 78 in the body of the slide 70. The blocking bar 80 slides vertically in a channel 100 formed in the body of the slide 70. External indicia 60 on the slide 70 may be used to indicate the blocked position at which the slide 70 will not cycle when fired, further reducing the noise produced when used in combination with a muzzle-mounted suppressor.

The frame insert 82 may be sized to fit within a void 102 that is part of the design of a standard fifth generation (Gen5) Glock-pattern frame 66, including the Glock 19X. This may vary in other Glock-pattern generations. To retain the frame insert 82 in place in this void 102, the frame insert 82 may include a boss or projection 104 sized to be received in a recess 106 of the trigger mechanism housing 108 (best illustrated in FIGS. 15 and 16). For installation, the frame insert 82 may be positioned against the trigger mechanism housing 108 with the projection 104 in the recess 106 and then inserted into the frame 66 as a combined unit. After placement, the trigger mechanism housing 108 and, thus, the frame insert 82, are secured to the frame 66 with an assembly pin 109 in the standard and well-known manner.

In other embodiments, a blocking member could be mounted elsewhere on the slide or frame and movable to slide a member to engage a notch/socket in the other part or against a guide rail on the frame/slide to block movement of the slide while allowing the handgun to be fired.

Referring now to FIGS. 22-26, 27A, and 27B, therein is shown an alternate design for use with other handgun design, such as a 1911-pattern handgun. A slide blocking lever 124 may be mounted on the frame 12 to pivot coaxially with, but independently of, the manual safety lever 22, as in a previously described embodiment. In this embodiment, the pivoting lever 124 does not directly engage the slide 18. Instead, it moves a blocking member 130 vertically in a slide channel 136 formed in the frame 12. When retracted into the frame 12 (shown in FIGS. 23 and 27B), the blocking member 130 does not interfere with movement of the slide 18 on the guide channel 40 or rails 38. When lifted to an engaged position (shown in FIGS. 24, 25, and 27A), it seats in an unexposed recess (not shown) of the slide 18 to block sliding movement.

The lever 124 can engage the blocking member 130 by way of a dog or pin 134 that slides in a horizontally elongated slot 132 in the blocking member 130, for example. The elongation of the slot 132 allows pivotal movement of the lever 124 to translate into the linear (vertical) movement of the blocking member 130. The blocking member 130 and its channel 136 are not exposed and no exposed notch (shown at 42 in the first embodiment) on the slide 18 is needed. A detent mechanism 52, as previously described, may be used for the manual blocking lever 124 of this embodiment.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A mechanism for selectively preventing cycling of a semiautomatic handgun having a frame and a longitudinally reciprocating slide, the device comprising:

a pivotal blocking lever on one of the slide or frame and that is selectively movable between a first position that allows the slide to cycle when the handgun is fired and a second position in which a blocking member mechanically bridges between the frame and slide to block cycling movement of the slide when the handgun is fired, wherein the blocking lever pivots coaxially with, but on an opposite side of the frame from, a pivoting manual safety switch.

2. The device of claim 1, wherein the blocking member on the blocking lever includes an abutment that moves in an arcuate path along a recess in the frame and into a notch formed on the slide.

3. The device of claim 1, wherein pivotal movement of the blocking lever causes substantially linear movement of the blocking member in a channel in the frame to move the blocking member between the first and second positions.

4. The device of claim 1, wherein the blocking lever is mounted on the slide and moves the blocking member along a substantially linear path between the first and second positions.

5. The device of claim 4, wherein the blocking lever includes teeth that engage teeth on the blocking member such that pivotal movement of the blocking lever causes substantially linear movement of the blocking member between the first and second positions.

* * * * *